US007944147B2

(12) United States Patent
Kawase et al.

(10) Patent No.: US 7,944,147 B2
(45) Date of Patent: May 17, 2011

(54) PLASMA DISPLAY PANEL

(75) Inventors: Akira Kawase, Osaka (JP); Kazuhiro Morioka, Kyoto (JP); Kazuhiro Yokota, Hyogo (JP); Yui Saitou, Osaka (JP); Tatsuo Mifune, Osaka (JP)

(73) Assignee: Panasonic Corporation, Osaka (JP)

( * ) Notice: Subject to any disclaimer, the term of this patent is extended or adjusted under 35 U.S.C. 154(b) by 0 days.

(21) Appl. No.: 12/580,754

(22) Filed: Oct. 16, 2009

(65) Prior Publication Data

US 2010/0133985 A1 Jun. 3, 2010

Related U.S. Application Data

(62) Division of application No. 11/791,078, filed as application No. PCT/JP2006/319181 on Sep. 27, 2006.

(30) Foreign Application Priority Data

Oct. 3, 2005 (JP) ..... 2005-289786
Jul. 28, 2006 (JP) ..... 2006-205910

(51) Int. Cl.
*H01J 17/49* (2006.01)

(52) U.S. Cl. ..... 313/582; 313/587

(58) Field of Classification Search ..... None
See application file for complete search history.

(56) References Cited

U.S. PATENT DOCUMENTS 7,298,085 B2 11/2007 Kwon et al.
7,326,666 B2 2/2008 Yamamoto et al.
7,501,763 B2 * 3/2009 Hashimoto et al. ..... 313/587
2001/0046934 A1 11/2001 Naumann et al.
2002/0036466 A1 3/2002 Tanaka et al.
2003/0108753 A1 6/2003 Fujii et al.
2004/0246204 A1 12/2004 Aoki et al.
2005/0181927 A1 8/2005 Hasegawa et al.
2005/0242725 A1 11/2005 Hasegawa et al.

FOREIGN PATENT DOCUMENTS

JP 9-50769 2/1997
JP 2001-48577 2/2001
JP 2002-53342 2/2002
JP 2003-128430 5/2003

(Continued)

OTHER PUBLICATIONS

United States Office Action issued in U.S. Appl. No. 11/791,078 dated Dec. 24, 2009.

(Continued)

*Primary Examiner* — Ashok Patel
(74) *Attorney, Agent, or Firm* — McDermott Will & Emery LLP

(57) ABSTRACT

A plasma display panel (PDP) is made of front panel (2) and a rear panel. The front panel includes display electrodes (6), dielectric layer (8), and protective layer (8) that are formed on glass substrate (3). The rear panel includes electrodes, barrier ribs, and phosphor layers that are formed on a substrate. The front panel and the rear panel are faced with each other, and the peripheries thereof are sealed to form a discharge space therebetween. Each of display electrodes (6) contains at least silver. Dielectric layer (8) is made of first dielectric layer (81) that contains bismuth oxide and calcium oxide and covers display electrodes (6), and second dielectric layer (82) that contains bismuth oxide and barium oxide and covers first dielectric layer (81).

8 Claims, 1 Drawing Sheet

FOREIGN PATENT DOCUMENTS

| | | | |
|---|---|---|---|
| JP | 2003-192376 | | 7/2003 |
| JP | 2004-238273 | | 8/2004 |
| JP | 2005-8512 | | 1/2005 |
| JP | 2005-038824 | | 2/2005 |
| JP | 2005-38824 | | 2/2005 |
| JP | 2005-041734 | | 2/2005 |
| JP | 2005-41734 | | 2/2005 |
| JP | 2005-231923 | | 9/2005 |
| KR | 10-2004-0101031 | A | 12/2004 |
| KR | 10-2005-0043711 | A | 5/2005 |

OTHER PUBLICATIONS

United States Notice of Allowance issued in U.S. Appl. No. 11/791,078 dated May 17, 2010.

European Search Report issued in Patent Application No. 06810646.7-2208 / 1933352 PCT/JP2006319181 dated on Sep. 29, 2008.

Korean Office Action issued in Korean Patent Application No. KR 10-2007-7017368 dated Dec. 29, 2008.

Korean Office Action issued in Korean Patent Application No. KR 10-2007-7017368 dated Jun. 12, 2008.

* cited by examiner

PLASMA DISPLAY PANEL

CROSS-REFERENCE TO RELATED APPLICATIONS

This application is a Divisional of U.S. application Ser. No. 11/791,078, filed on May 18, 2007, which is a U.S. National Phase under 35 U.S.C. § of International Application No. PCT/JP2006/319181, filed Sep. 27, 2006, claiming priority of Japanese Patent Application No. 2005-289786, filed on Oct. 3, 2005 and Japanese Patent Application No. 2006-205910, filed Jul. 28, 2006, the entire contents of each of which are hereby incorporated by reference.

TECHNICAL FIELD

The present invention relates to a plasma display panel for use in a display device and the like.

BACKGROUND ART

A plasma display panel (hereinafter referred to as a PDP) can achieve higher definition and have a larger screen. Thus, a television screen using a PDP approx. 65 inch in diagonal is commercially available. Recently, with advancement of application of PDPs to high definition televisions having the number of scanning lines twice as many as conventional televisions compliant with the National Television System Committee (NTSC) system, PDPs containing no lead to address environmental issues have been required.

A PDP is basically made of a front panel and a rear panel. The front panel includes a glass substrate made of sodium borosilicate glass by the float method, display electrodes that are made of stripe-like transparent electrodes and bus electrodes formed on the principle surface of the glass substrate on one side thereof, a dielectric layer covering the display electrodes and working as a capacitor, and a protective layer that is made of magnesium oxide (MgO) formed on the dielectric layer. On the other hand, the rear panel is made of a glass substrate, stripe-like address electrodes formed on the principle surface of the glass substrate on one side thereof, a primary dielectric layer covering the address electrodes, barrier ribs formed on the primary dielectric layer, and phosphor layers formed between the respective barrier ribs and emitting light in red, green, or blue.

The front panel and rear panel are hermetically sealed with the electrode-forming sides thereof faced with each other. A Ne—Xe discharge gas is charged in the discharge space partitioned by the barrier ribs, at a pressure ranging from 400 to 600 Torr. For a PDP, selective application of image signal voltage to the display electrodes makes the electrodes discharge. Then, the ultraviolet light generated by the discharge excites the respective phosphor layers so that they emit light in red, green, or blue to display color images.

Silver electrodes are used for the bus electrodes in the display electrodes to ensure electrical conductivity thereof. Low-melting glass essentially consisting of lead oxide is used for the dielectric layer. The examples of a lead-free dielectric layer addressing recent environmental issues are disclosed in Japanese Patent Unexamined Publication Nos. 2003-128430, 2002-053342, 2001-048577, and H09-050769.

An increasing number of PDPs has recently been applied to high definition televisions having the number of scanning lines at least twice as many as conventional NTSC-compliant televisions.

For such compliance with high definition increases the numbers of scanning lines and display electrodes, and decreases the spacing between the display electrodes. These changes increase silver ions diffused into the dielectric layer and glass substrate, from the silver electrodes constituting the display electrodes. When the silver ions diffuse into the dielectric layer and glass substrate, the silver ions are reduced by alkali metal ions in the dielectric layer, and bivalent tin ions contained in the glass substrate, thus forming silver colloids. These colloids cause a yellowing phenomenon in which the dielectric layer or glass substrate strongly colors into yellow or brown. Additionally, the silver oxide reduced generates oxygen, thus bubbles in the dielectric layer.

Thus, an increase in the number of scanning lines more conspicuously yellows the glass substrate and generates bubbles in the dielectric layer, thus considerably degrading the image quality and causing insulation failures in the dielectric layer.

However, in the examples of the conventional lead-free dielectric layer proposed to address environmental issues, the yellowing phenomenon and insulation failures of the dielectric layer cannot be inhibited at the same time.

SUMMARY OF THE INVENTION

A plasma display panel (PDP) of the present invention is made of a front panel and a rear panel. The front panel includes display electrodes, a dielectric layer, and a protective layer that are formed on a glass substrate. The rear panel includes electrodes, barrier ribs, and phosphor layers that are formed on a substrate. The front panel and the rear panel are faced with each other, and the peripheries thereof are sealed to form a discharge space therebetween. Each of the display electrodes contains at least silver. The dielectric layer is made of a first dielectric layer that contains bismuth oxide and calcium oxide and covers the display electrodes, and a second dielectric layer that contains bismuth oxide and barium oxide and covers the first dielectric layer.

Such a structure can provide an echo-friendly PDP with high image display quality that includes a dielectric layer having a minimized yellowing phenomenon and dielectric strength deterioration and a high visible-light transmittance.

REFERENCE MARKS IN THE DRAWINGS

| | |
|---|---|
| 1 | Plasma display panel (PDP) |
| 2 | Front panel |
| 3 | Front glass substrate |
| 4 | Scan electrode |
| 4a, 5a | Transparent electrode |
| 4b, 5b | Metal bus electrode |
| 5 | Sustain electrode |
| 6 | Display electrode |
| 7 | Black stripe (lightproof layer) |
| 8 | Dielectric layer |
| 9 | Protective layer |
| 10 | Rear panel |
| 11 | Rear glass substrate |
| 12 | Address electrode |

-continued

| | |
|---|---|
| 13 | Primary dielectric layer |
| 14 | Barrier rib |
| 15 | Phosphor layer |
| 16 | Discharge space |
| 81 | First dielectric layer |
| 82 | Second dielectric layer |

DETAILED DESCRIPTION OF PREFERRED EMBODIMENTS

Hereinafter, a description is provided of a plasma display panel (PDP) in accordance with the exemplary embodiment of the present invention, with reference to the accompanying drawings.

Exemplary Embodiment

Figure 1:
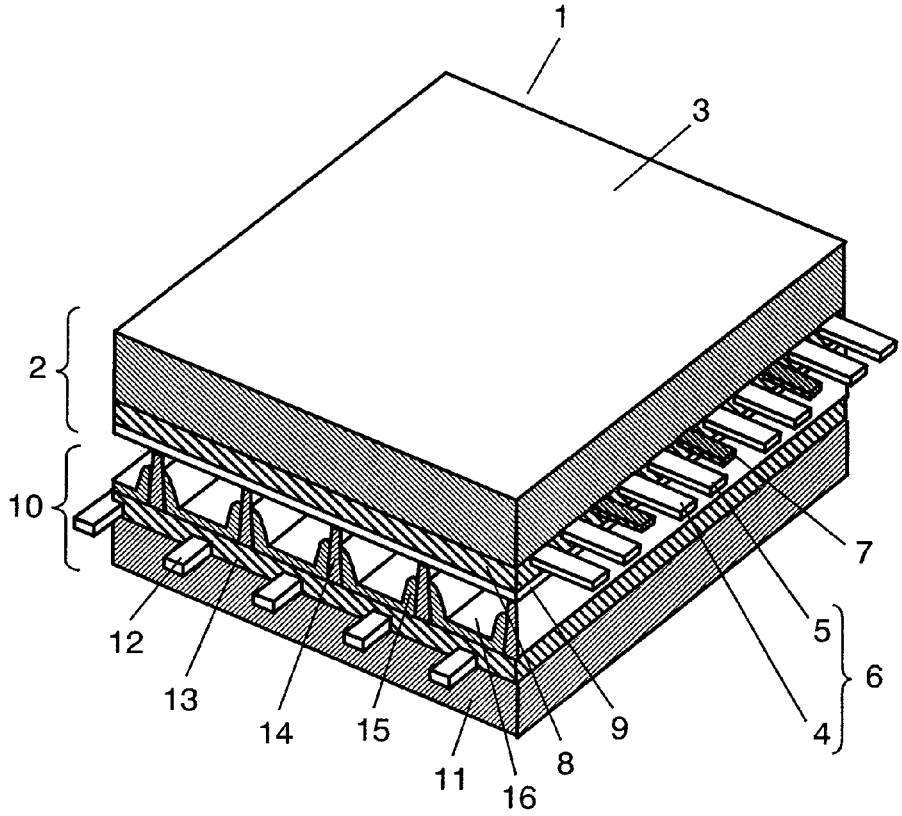
FIG. 1 is a perspective view illustrating a structure of a plasma display panel (PDP) in accordance with an exemplary embodiment of the present invention.

FIG. 1 is a perspective view illustrating a structure of a PDP in accordance with the exemplary embodiment of the present invention. The PDP is similar to a general alternating-current surface-discharge PDP in basic structure. As shown in FIG. 1, for PDP1, front panel 2 including front glass substrate 3, and rear panel 10 including rear glass substrate 11 are faced with each other, and the outer peripheries thereof are hermetically sealed with a sealing material (not shown) including glass frits. Into discharge space 16 in sealed PDP1, a discharge gas including Ne and Xe is charged at a pressure ranging from 400 to 600 Torr.

On front glass substrate 3 of front panel 2, a plurality of rows of display electrodes 6, each made of a pair of stripe-like scan electrode 4 and sustain electrode 5, and black stripes (lightproof layers) 7 are disposed in parallel with each other. Formed on front glass substrate 3 is dielectric layer 8 covering display electrodes 6 and lightproof layers 7 and working as a capacitor. Further on the surface of the dielectric layer, protective layer 9 including magnesium oxide (MgO) is formed.

On rear glass substrate 11 of rear panel 10, a plurality of stripe-like address electrodes 12 are disposed in parallel with each other in the direction orthogonal to scan electrodes 4 and sustain electrodes 5 of front panel 2. Primary dielectric layer 13 coats the address electrodes. Further on primary dielectric layer 13 between address electrodes 12, barrier ribs 14 having a predetermined height are formed to partition discharge space 16. Phosphor layers 15 are sequentially applied to the grooves between barrier ribs 14 so that ultraviolet light excites the phosphor layers to emit light in red, green, or blue for each address electrode 12. Discharge cells are formed in the positions where scan electrodes 4 and sustain electrodes 5 intersect address electrodes 12. The discharge cells that include phosphor layers 15 in red, green, or blue and are arranged in the direction of display electrodes 6 form pixels for color display.

Figure 2:
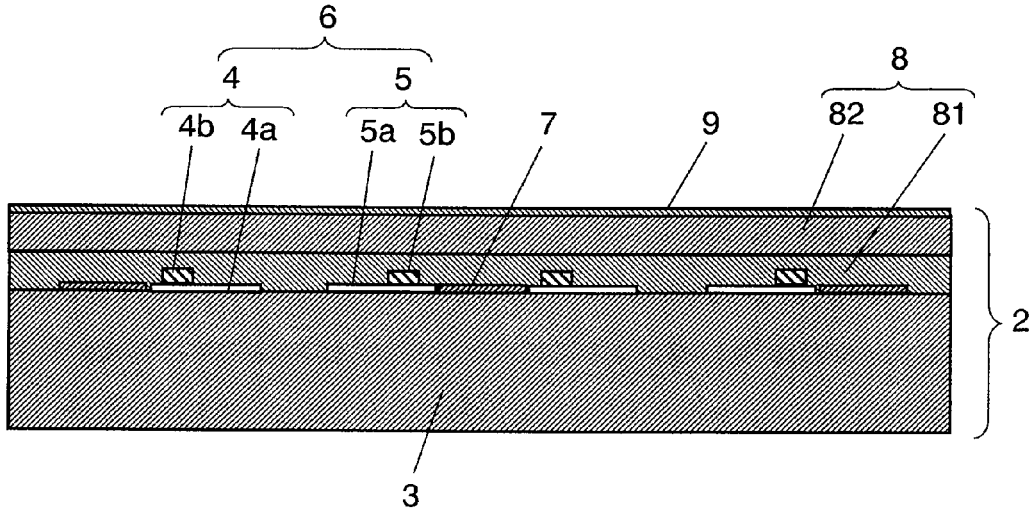
FIG. 2 is a sectional view of a front panel illustrating a structure of a dielectric layer of the PDP in accordance with the exemplary embodiment of the present invention.

FIG. 2 is a sectional view of front panel 2 illustrating a structure of dielectric layer 8 of the PDP in accordance with the exemplary embodiment of the present invention. FIG. 2 shows a vertically inverted view of FIG. 1. As shown in FIG. 2, display electrodes 6, each made of scan electrode 4 and sustain electrode 5, and lightproof layers 7 are patterned on front glass substrate 3 made by the float method or the like. Display electrodes 4 and sustain electrodes 5 include transparent electrodes 4*a* and 5*a* made of indium tin oxide (ITO) or tin oxide ($SnO_2$), and metal bus electrodes 4*b* and 5*b* formed on transparent electrodes 4*a* and 5*a*, respectively. Metal bus electrodes 4*b* and 5*b* are used to impart electrical conductivity to transparent electrodes 4*a* and 5*a* in the longitudinal direction thereof, and made of a conductive material essentially consisting of silver (Ag) material.

Dielectric layer 8 is structured of at least two layers: first dielectric layer 81 covering transparent electrodes 4*a* and 5*a*, metal bus electrodes 4*b* and 5*b*, and lightproof layers 7 formed on front glass substrate 3; and second dielectric layer 82 formed on first dielectric layer 81. Further, protective layer 9 is formed on second dielectric layer 82.

Next, a description is provided of a method of manufacturing a PDP. First, scan electrodes 4, sustain electrodes 5, and lightproof layers 7 are formed on front glass substrate 3. These transparent electrodes 4*a* and 5*a*, and metal bus electrodes 4*b* and 5*b* are patterned by methods including the photo lithography method. Transparent electrodes 4*a* and 5*a* are formed by the thin film process or the like. Metal bus electrodes 4*b* and 5*b* are solidified by firing a paste containing a silver (Ag) material at a predetermined temperature. Lightproof layers 7 are formed by the similar method. A paste containing a black pigment is silk-screened, or a black pigment is applied to the entire surface of the glass substrate and patterned by the photo lithography method, and then the paste or the pigment is fired.

Next, a dielectric paste is applied to front glass substrate 3 to cover scan electrodes 4, sustain electrodes 5, and lightproof layers 7 by the die coat method or the like, to form a dielectric paste layer (dielectric material layer). Leaving the dielectric paste for a predetermined period after application levels the surface of the applied dielectric paste and provides a flat surface. Thereafter, solidifying the dielectric paste layer by firing forms dielectric layer 8 covering scan electrodes 4, sustain electrodes 5, and lightproof layers 7. The dielectric paste is a paint containing a dielectric material, such as a glass powder, as well as a binder, and a solvent. Next, protective layer 9 made of magnesium oxide (MgO) is formed on dielectric layer 8 by vacuum deposition. With these steps, a predetermined structure (scan electrodes 4, sustain electrodes 5, lightproof layers 7, dielectric layer 8, and protective layer 9) is formed on front glass substrate 3. Thus, front panel 2 is completed.

On the other hand, rear panel 10 is formed in the following steps. First, a material layer to be a structure for address electrodes 12 is formed by silk-screening a paste containing silver (Ag) material on rear glass substrate 11, or forming a metal layer on the entire rear glass substrate followed by patterning the layer by the photo lithography method. Then, the structure is fired at a desired temperature, to form address electrodes 12. Next, on rear glass substrate 11 having address electrodes 12 formed thereon, a dielectric paste is applied to cover address electrodes 12 by the die coat method or the like, to form a dielectric paste layer. Thereafter, the dielectric paste layer is fired, to form primary dielectric layer 13. The dielectric paste is a paint containing a dielectric material, such as glass powder, as well as a binder, and a solvent.

Next, after a paste for forming barrier ribs containing a barrier rib material is applied to primary dielectric layer 13 and patterned into a predetermined shape to form a barrier rib material layer, the material layer is fired to form barrier ribs 14. The usable methods of patterning the barrier rib paste applied to primary dielectric layer 13 include the photo lithography method and sandblast method. Next, a phosphor paste containing a phosphor material is applied to primary dielectric layer 13 between adjacent barrier ribs 14 and the side surfaces of barrier ribs 14 and fired, to form phosphor layers 15. With these steps, rear panel 10 including predetermined structural members on rear glass substrate 11 is completed.

Front panel 2 and rear panel 10 including predetermined structural members manufactured as above are faced with each other so that scan electrodes 4 are orthogonal to address electrodes 12. Then, the peripheries of the panels are sealed with glass frits, and a discharge gas including Ne and Xe is charged into discharge space 16. Thus, PDP 1 is completed.

A detailed description is provided of first dielectric layer 81 and second dielectric layer 82 constituting dielectric layer 8 of front panel 2. The dielectric material of first dielectric layer 81 is composed of the following components: 20 to 40 wt % of bismuth oxide ($Bi_2O_3$), 0.5 to 15 wt % of calcium oxide (CaO), and 0.1 to 7 wt % of at least one selected from molybdenum trioxide ($MoO_3$), tungstic trioxide ($WO_3$), cerium dioxide ($CeO_2$), and manganese dioxide ($MnO_2$).

Further, the dielectric material contains 0.5 to 12 wt % of at least one selected from strontium oxide (SrO) and barium oxide (BaO).

In place of molybdenum trioxide ($MoO_3$), tungstic trioxide ($WO_3$), cerium dioxide ($CeO_2$), and manganese dioxide ($MnO_2$), the dielectric material may contain 0.1 to 7 wt % of at least one selected from cupper oxide (CuO), chromium oxide ($Cr_2O_3$), cobalt oxide ($Co_2O_3$), vanadium oxide ($V_2O_7$), and antimony oxide ($Sb_2O_3$).

In addition to the above components, the dielectric material may contain components other than lead, such as 0 to 40 wt % of zinc oxide (ZnO), 0 to 35 wt % of boron oxide ($B_2O_3$), 0 to 15 wt % of silicon dioxide ($SiO_2$), and 0 to 10 wt % of aluminum oxide ($Al_2O_3$). The contents of these components are not specifically limited, and are within the range of the contents in the conventional arts.

The dielectric material having such composition is pulverized with a wet jet mill or ball mill to have an average particle diameter ranging from 0.5 to 2.5 μm, to provide a dielectric material powder. Next, 55 to 70 wt % of this dielectric material powder and 30 to 45 wt % of binder components are sufficiently kneaded with a three-roll kneader, to provide a first dielectric layer paste for die coat or printing.

The binder components include ethylcellulose, terpioneol containing 1 to 20 wt % of acrylate resin, or butyl carbitol acetate. As needed, the paste may additionally contain dioctyl phthalate, dibutyl phthalate, triphenyl phosphate, or tributyl phosphate, as a plasticizer, and glycerol monooleate, sorbitan sesquioleate, or alkyl-aryl phosphate esters, as a dispersant, to improve printability.

Next, the paste for the first dielectric layer is applied to front glass substrate 3 to cover display electrodes 6 by the die coat or silk-screen printing method, and dried. Thereafter, the paste is fired at a temperature ranging from 575 to 590° C., slightly higher than the softening point of the dielectric material, to provide first dielectric layer 81.

Next, a description is provided of second dielectric layer 82. The dielectric material of second dielectric layer 82 is composed of the following components: 11 to 40 wt % of bismuth oxide ($Bi_2O_3$), 6 to 28 wt % of barium oxide (BaO), and 0.1 to 7 wt % of at least one selected from molybdenum trioxide ($MoO_3$), tungstic trioxide ($WO_3$), cerium dioxide ($CeO_2$), and manganese dioxide ($MnO_2$).

Further, the dielectric material contains 0.8 to 17 wt % of at least one selected from calcium oxide (CaO) and strontium oxide (SrO).

In place of molybdenum trioxide ($MoO_3$), tungstic trioxide ($WO_3$), cerium dioxide ($CeO_2$), and manganese dioxide ($MnO_2$), the dielectric material may contain 0.1 to 7 wt % of at least one selected from cupper oxide (CuO), chromium oxide ($Cr_2O_3$), cobalt oxide ($Co_2O_3$), vanadium oxide ($V_2O_7$), and antimony oxide ($Sb_2O_3$).

In addition to the above components, the dielectric material may contain components other than lead, such as 0 to 40 wt % of zinc oxide (ZnO), 0 to 35 wt % of boron oxide ($B_2O_3$), 0 to 15 wt % of silicon dioxide ($SiO_2$), and 0 to 10 wt % of aluminum oxide ($Al_2O_3$). The contents of these components are not specifically limited, and are within the range of the contents in the conventional arts.

The dielectric material having such composition is pulverized with a wet jet mill or ball mill to have an average particle diameter ranging from 0.5 to 2.5 μm, and a dielectric material powder is provided. Next, 55 to 70 wt % of this dielectric material powder and 30 to 45 wt % of binder components are sufficiently kneaded with a three-roll kneader, to provide a second dielectric layer paste for die coat or printing. The binder components include ethylcellulose, terpioneol containing 1 to 20 wt % of acrylate resin, or butyl carbitol acetate. As needed, the paste may additionally contain dioctyl phthalate, dibutyl phthalate, triphenyl phosphate, or tributyl phosphate, as a plasticizer, and glycerol monooleate, sorbitan sesquioleate, or alkyl aryl phosphate esters, as a dispersant, to improve printability.

Next, the paste for the second dielectric layer is applied to first dielectric layer 81 by the silk-screen printing method or the die coat method, and dried. Thereafter, the paste is fired at a temperature ranging from 550 to 590° C., slightly higher than the softening point of the dielectric material, to provide second dielectric layer 82.

The advantage of increasing the brightness of the panel and decreasing the discharge voltage is more distinct at the smaller thickness of dielectric layer 8. For this reason, preferably, the thickness is as small as possible within the range in which the dielectric voltage does not decrease. From the viewpoints of these conditions and visible-light transmittance, in this exemplary embodiment of the present invention, the thickness of dielectric layer 8 is up to 41 μm, with that of first dielectric layer 81 ranging from 5 to 15 μm and that of second dielectric layer 82 ranging from 20 to 36 μm.

For second dielectric layer 82, with a content of bismuth oxide ($Bi_2O_3$) up to 11 wt %, coloring is unlikely to occur, but bubbles are likely to foam in second dielectric layer 82. Thus, this content is not preferable. With a content of bismuth oxide ($Bi_2O_3$) exceeding 40 wt %, coloring is likely to occur. For this reason, this content is not preferable to increase the transmittance.

Further, it is necessary that there should be a difference in the content of bismuth oxide ($Bi_2O_3$) between first dielectric layer 81 and second dielectric layer 82. This is confirmed by the following phenomenon: when the contents of bismuth oxide ($Bi_2O_3$) are the same in first dielectric layer 81 and second dielectric layer 82, the influence of the bubbles generated in first dielectric layer 81 also generates bubbles in second dielectric layer 82 during the step of firing second dielectric layer 82.

When the content of bismuth oxide ($Bi_2O_3$) in second dielectric layer 82 is smaller than that of bismuth oxide ($Bi_2O_3$) in first dielectric layer 81, the following advantage is further shown. In other words, because second dielectric layer 82 accounts for at least approx. 50% of the total thickness of dielectric layer 8, coloring caused by the yellowing phenomenon is unlikely to occur and the transmittance can be increased. Additionally, because the Bi-based materials are expensive, the cost of the raw materials to be used can be reduced.

On the other hand, when the content of bismuth oxide ($Bi_2O_3$) in second dielectric layer 82 is larger than the content of bismuth oxide ($Bi_2O_3$) in first dielectric layer 81, the softening point of second dielectric layer 82 can be lowered and thus removal of bubbles in the firing step can be promoted.

It is confirmed that a PDP manufactured in this manner includes front glass substrate 3 having a minimized coloring (yellowing) phenomenon, and dielectric layer 8 having no bubbles generated therein and an excellent dielectric strength, even with the use of a silver (Ag) material for display electrodes 6.

Next, consideration is given to the reasons why these dielectric materials inhibit yellowing or foaming in first dielectric layer 81, in a PDP in accordance with the exemplary embodiment of the present invention. It is known that addition of molybdenum trioxide ($MoO_3$) or tungstic trioxide ($WO_3$) to dielectric glass containing bismuth oxide ($Bi_2O_3$) is likely to generate compounds, such as $Ag_2MoO_4$, $Ag_2Mo_2O_7$, $Ag_2Mo_4O_{13}$, $Ag_2WO_4$, $Ag_2W_2O_7$, and $Ag_2W_4O_{13}$, at a low temperature up to 580° C. In the exemplary embodiment of the present invention, the firing temperature of dielectric layer 8 ranges from 550 to 590° C. Thus, silver ions ($Ag^+$) diffused in dielectric layer 8 during firing react with molybdenum trioxide ($MoO_3$), tungstic trioxide ($WO_3$), cerium dioxide ($CeO_2$), and manganese dioxide ($MnO_2$) in dielectric layer 8, generate stable compounds, and stabilize. In other words, because the silver ions ($Ag^+$) are not reduced and are stabilized, the ions do not coagulate into colloids. Consequently, the stabilization of the silver ions ($Ag^+$) decreases oxygen generated by colloidization of silver (Ag), thus reducing the bubbles generated in dielectric layer 8.

On the other hand, preferably, the content of molybdenum trioxide ($MoO_3$), tungstic trioxide ($WO_3$), cerium dioxide ($CeO_2$), or manganese dioxide ($MnO_2$) in the dielectric glass containing bismuth oxide ($Bi_2O_3$) is at least 0.1 wt %, to offer these advantages. More preferably, the content ranges from 0.1 to 7 wt %. Particularly with a content smaller than 0.1 wt %, the advantage of inhibiting yellowing is smaller. With a content exceeding 7 wt %, yellowing occurs in the glass, and thus is not preferable.

Calcium oxide (CaO) contained in first dielectric layer 81 works as an oxidizer in the firing step of first dielectric layer 81, and has an effect of promoting removal of binder components remaining in display electrodes 6. On the other hand, barium oxide (BaO) contained in second dielectric layer 82 has an effect of increasing the transmittance of second dielectric layer 82.

In other words, for dielectric layer 8 of the PDP in accordance with the exemplary embodiment of the present invention, first dielectric layer 81 in contact with metal bus electrodes 4*b* and 5*b* made of a silver (Ag) material inhibits the yellowing phenomenon and foaming, and second dielectric layer 82 provided on first dielectric layer 81*a* achieves high light transmittance. This structure can provide a PDP that has extremely minimized yellowing and foaming, and high transmittance in the entire dielectric layer 8.

EXAMPLES

For PDPs in accordance with this exemplary embodiment of the present invention, PDPs suitable for a high definition television screen approx. 42 inch in diagonal are fabricated and their performances are evaluated. Each of the PDPs includes discharge cells having 0.15-mm-high barrier ribs at a regular spacing (cell pitch) of 0.15 mm, display electrodes at a regular spacing of 0.06 mm, and a Ne—Xe mixed gas containing 15 vol % of Xe charged at a pressure of 60 kPa.

First dielectric layers and second dielectric layers shown in Tables 1 and 2 are fabricated. PDPs under the conditions of Table 3 are fabricated by combination of these dielectric layers. Table 3 shows panel Nos. 1 through 26, as the examples of a PDP in accordance with the exemplary embodiment of the present invention, and panel Nos. 27 through 30, as comparative examples thereof. Sample Nos. A12, A13, B11, and B12 of the compositions shown in Tables 1 and 2 are also comparative examples in the present invention. "Other components" shown in the columns of Tables 1 and 2 are components other than lead as described above, such as zinc oxide (ZnO), boron oxide ($B_2O_3$), silicon dioxide ($SiO_2$), and aluminum oxide ($Al_2O_3$). The contents of these components are not specifically limited, and are within the range of the contents in the conventional arts.

TABLE 1

| Composition of dielectric | Sample No. of first dielectric layer | | | | | | | | | | | | |
|---|---|---|---|---|---|---|---|---|---|---|---|---|---|
| glass (wt %) | A1 | A2 | A3 | A4 | A5 | A6 | A7 | A8 | A9 | A10 | A11 | A12* | A13* |
| $Bi_2O_3$ | 25 | 27 | 35 | 31 | 40 | 31 | 23 | 22 | 20 | 25 | 27 | 15 | 35 |
| CaO | 0.5 | 2.5 | 6.0 | 9.0 | 8.1 | 12 | 12 | 0.5 | 3.8 | 2.4 | 15 | — | 8.0 |
| SrO | 3.0 | 0.9 | — | — | — | — | — | — | 12 | — | — | — | — |
| BaO | — | 1.6 | 7.0 | — | — | — | — | 11 | — | 0.5 | — | — | 7.0 |
| $MoO_3$ | 4.0 | 0.5 | 2.0 | 0.5 | 0.5 | 3.0 | 0.3 | 0.5 | 0.1 | — | — | 2.0 | — |
| $WO_3$ | 2.5 | — | — | — | 1.0 | — | — | — | 7.0 | — | 3.0 | 5.0 | — |
| $CeO_2$ | — | — | — | — | — | — | — | 1.0 | — | 3.0 | — | — | — |
| $MnO_2$ | — | — | — | — | — | — | — | 5.0 | 0.7 | — | 1.0 | — | — |
| Other components | 65 | 68 | 50 | 60 | 50 | 55 | 64 | 60 | 57 | 69 | 54 | 78 | 50 |

*Sample Nos. 12 and 13 are comparative examples.

**"Other components" contain no lead.

TABLE 2

| Composition of dielectric | Sample No. of second dielectric layer | | | | | | | | | | | |
|---|---|---|---|---|---|---|---|---|---|---|---|---|
| glass (wt %) | B1 | B2 | B3 | B4 | B5 | B6 | B7 | B8 | B9 | B10 | B11* | B12* |
| $Bi_2O_3$ | 11 | 12 | 19 | 19 | 20 | 34 | 18 | 40 | 32 | 27 | 31 | 10 |
| CaO | 17 | 5.4 | — | 1.6 | 2.0 | — | — | — | — | 8.6 | 12 | — |

TABLE 2-continued

| Composition of dielectric glass (wt %) | Sample No. of second dielectric layer B1 | B2 | B3 | B4 | B5 | B6 | B7 | B8 | B9 | B10 | B11* | B12* |
|---|---|---|---|---|---|---|---|---|---|---|---|---|
| SrO | — | — | — | — | 1.6 | — | — | — | 0.8 | — | — | — |
| BaO | 11 | 10 | 21 | 16 | 6.0 | 16 | 24 | 18 | 22 | 28 | — | 14 |
| $MoO_3$ | 2.0 | — | — | — | — | — | 0.7 | — | — | 1.7 | 3.0 | — |
| $WO_3$ | — | 7.0 | — | 0.7 | — | — | — | 0.8 | 3.2 | — | — | — |
| $CeO_2$ | 0.1 | 1.0 | 1.0 | 3.0 | 0.2 | 0.3 | 0.3 | — | — | — | — | — |
| $MnO_2$ | — | — | — | — | — | — | — | 0.7 | — | 2.3 | — | — |
| $Li_2O$ | — | — | — | — | — | 0.7 | — | 0.5 | 0.8 | 1.3 | — | — |
| Other components** | 60 | 65 | 59 | 60 | 70 | 49 | 57 | 40 | 41 | 31 | 55 | 77 |

*Sample Nos. B11 and B12 are comparative examples.
**"Other components" contain no lead.

TABLE 3

| Panel No. | Sample No. of second dielectric layer/Sample No. of first dielectric layer | Thickness of second dielectric layer/Thickness of first dielectric layer (μm) | Transmittance of dielectric layer (%) | b* value | PDPs with dielectric breakdown after accelerated life tests (pcs) |
|---|---|---|---|---|---|
| 1 | No. B1/No. A1 | 20/15 | 90 | 1.8 | 0 |
| 2 | No. B2/No. A2 | 26/13 | 89 | 1.9 | 0 |
| 3 | No. B3/No. A3 | 30/10 | 87 | 1.9 | 0 |
| 4 | No. B4/No. A4 | 26/14 | 88 | 2 | 0 |
| 5 | No. B5/No. A5 | 35/5 | 89 | 2.8 | 0 |
| 6 | No. B1/No. A6 | 23/15 | 86 | 2 | 0 |
| 7 | No. B6/No. A7 | 25/10 | 88 | 1.9 | 0 |
| 8 | No. B7/No. A8 | 25/10 | 87 | 1.8 | 0 |
| 9 | No. B8/No. A9 | 25/10 | 88 | 2.1 | 0 |
| 10 | No. B9/No. A10 | 25/10 | 89 | 2.1 | 0 |
| 11 | No. B10/No. A11 | 25/10 | 88 | 1.9 | 0 |
| 12 | No. B2/No. A3 | 28/10 | 88 | 2.1 | 0 |
| 13 | No. B3/No. A4 | 25/10 | 91 | 2 | 0 |
| 14 | No. B4/No. A5 | 25/10 | 87 | 2.4 | 0 |
| 15 | No. B5/No. A6 | 25/10 | 88 | 2.2 | 0 |
| 16 | No. B7/No. A7 | 25/10 | 89 | 1.8 | 0 |
| 17 | No. B8/No. A8 | 25/10 | 87 | 1.9 | 0 |
| 18 | No. B9/No. A9 | 25/10 | 88 | 1.7 | 0 |
| 19 | No. B10/No. A10 | 25/10 | 88 | 1.9 | 0 |
| 20 | No. B1/No. A11 | 25/10 | 91 | 1.8 | 0 |
| 21 | No. B1/No. A3 | 25/10 | 90 | 2 | 0 |
| 22 | No. B5/No. A4 | 25/12 | 89 | 2.4 | 0 |
| 23 | No. B3/No. A5 | 25/10 | 88 | 2.5 | 0 |
| 24 | No. B3/No. A6 | 25/12 | 87 | 2.1 | 0 |
| 25 | No. B2/No. A1 | 25/10 | 91 | 1.8 | 0 |
| 26 | No. B3/No. A1 | 22/15 | 88 | 2 | 0 |
| 27* | No. B1/No. A12 | 25/10 | 91 | 2.1 | 3 |
| 28* | No. B3/No. A13 | 25/10 | 87 | 13.4 | 2 |
| 29* | No. B11/No. A6 | 25/10 | 83 | 2.8 | 4 |
| 30* | No. B12/No. A3 | 25/10 | 90 | 2 | 3 |

*Panel Nos. 27 through 30 are comparative examples.

In each of the PDPs of panel Nos. 1 through 26, metal bus electrodes 4*b* and 5*b* made of a silver (Ag) material are covered with first dielectric layer 81. As shown in Tables 1 through 3, the first dielectric layer is made by firing dielectric glass containing 20 to 40 wt % of bismuth oxide ($Bi_2O_3$), 0.5 to 15 wt % of calcium oxide (CaO), and 0.1 to 7 wt % of at least one selected from molybdenum trioxide ($MoO_3$), tungstic trioxide ($WO_3$), cerium dioxide ($CeO_2$), and manganese dioxide ($MnO_2$), at a temperature ranging from 560 to 590° C., to provide a thickness ranging from 5 to 15 μm.

Second dielectric layer 82 is further formed on first dielectric layer 81. The second dielectric layer is made by firing dielectric glass containing 11 to 40 wt % of at least bismuth oxide ($Bi_2O_3$), and 0.1 to 7 wt % of at least one selected from molybdenum trioxide ($MoO_3$), tungstic trioxide ($WO_3$), cerium dioxide ($CeO_2$), and manganese dioxide ($MnO_2$), and 0.8 to 17 wt % of at least one selected from calcium oxide (CaO) and strontium oxide (SrO), at a temperature ranging from 550 to 570° C., to provide a thickness ranging from 20 to 35 μm.

The PDPs of panel Nos. 27 and 28 show the results of a case where the dielectric glass of Table 1 constituting first dielectric layer 81 contains a small amount of bismuth oxide ($Bi_2O_3$), and a case where the dielectric glass contains no molybdenum trioxide ($MoO_3$), tungstic trioxide ($WO_3$), cerium dioxide ($CeO_2$), or manganese dioxide ($MnO_2$), respectively. The PDPs of panel Nos. 29 and 30 show the results of a case where the dielectric glass constituting second dielectric layer 82 and the dielectric glass constituting first dielectric layer 81 contain the same amount of bismuth oxide ($Bi_2O_3$), and a case where the dielectric glass contains no molybdenum trioxide ($MoO_3$), tungstic trioxide ($WO_3$), cerium dioxide ($CeO_2$), or manganese dioxide ($MnO_2$), respectively.

These PDPs of panel Nos. 1 through 30 are fabricated and evaluated for the following items. Table 3 shows the evaluation results. First, the transmittance of front panel 2 is measured using a spectrometer. Each of the measurement results shows an actual transmittance of dielectric layer 8 after deduction of the transmittance of front glass substrate 3 and the influence of the electrodes.

The degree of yellowing caused by silver (Ag) is measured with a colorimeter (CR-300 made by Minolta Co., Ltd.) to provide a b*value that indicates the degree of yellowing. As a threshold of the b*value at which yellowing affects the display performance of the PDP, b*=3. When the value is larger, yellowing is more conspicuous, the color temperature is lower, and the PDP is less preferable.

Further, 20 pieces of PDPs are fabricated for each of panel Nos. 1 through 30, and accelerated life tests are conducted on these PDPs. The accelerated life tests are conducted by discharging the PDPs at a discharge sustain voltage of 200V and a frequency of 50 kHz for 4 hours continuously. Thereafter, the number of PDPs of which dielectric layer has broken (dielectric voltage defect) is determined. Because the dielectric voltage defect is caused by such failures as bubbles generated in dielectric layer 8, it is considered that many bubbles have foamed in the panels having dielectric breakdown produced therein.

Results of Table 3 show, for the PDPs of panel Nos. 1 through 26 corresponding to those of this exemplary embodiment of the present invention, yellowing or foaming caused by silver (Ag) is inhibited, to provide high visible-light transmittances of the dielectric layer ranging from 86 to 91% and b*values concerning yellowing as low as 1.7 to 2.8, and no dielectric breakdown has occurred after the accelerated life tests.

In contrast, for the PDP of panel No. 27 in which the content of bismuth oxide ($Bi_2O_3$) in the dielectric glass of the first dielectric layer is as small as 15 wt % and contains no calcium oxide (CaO), the b*value indicating the degree of yellowing is as small as 2.1. However, low liquidity of the dielectric glass deteriorates adherence thereof to the display electrodes and front glass substrate, thus generating bubbles particularly in the interfaces thereof and increases dielectric breakdown after the accelerated life tests. For the PDP of panel No. 28 in which the dielectric glass of the first dielectric layer contains no molybdenum trioxide ($MoO_3$), tungstic trioxide ($WO_3$), cerium dioxide ($CeO_2$), or manganese dioxide ($MnO_2$), the degree of yellowing is high, and thus increases foaming and dielectric breakdown.

For the PDP of panel No. 29 in which the dielectric glass in the second dielectric layer and the dielectric glass in the first dielectric layer contain the same amount of bismuth oxide ($Bi_2O_3$) and contain no barium oxide (BaO) therein, the visible-light transmittance is decreased and foaming in the dielectric layer is increased. On the other hand, for the PDP of panel No. 30 in which the dielectric glass of the second dielectric layer contains a smaller amount of bismuth oxide ($Bi_2O_3$), and no molybdenum trioxide ($MoO_3$), tungstic trioxide ($WO_3$), cerium dioxide ($CeO_2$), or manganese dioxide ($MnO_2$), the visible-light transmittance is excellent, but poor glass liquidity increases foaming and thus conspicuous dielectric breakdown.

In the above description, at least one of molybdenum trioxide ($MoO_3$), tungstic trioxide ($WO_3$), cerium dioxide ($CeO_2$), and manganese dioxide ($MnO_2$) is contained in the dielectric glass of the first dielectric layer and the second dielectric layer. However, the advantages can be given by composition containing at least one selected from cupper oxide (CuO), chromium oxide ($Cr_2O_3$), cobalt oxide ($Co_2O_3$), vanadium oxide ($V_2O_7$), and antimony oxide ($Sb_2O_3$), in place of the components in the above description.

For the dielectric material, the content of each component described above has a measurement error in the range of approx. ±0.5 wt %. For the dielectric layer after firing, the content has a measurement error in the range of approx. ±2 wt %. The contents of the components in the range of the values including these errors can provide the similar advantages of the present invention.

As described above, a PDP in accordance with the exemplary embodiment of the present invention can provide an eco-friendly PDP that includes a lead-free dielectric layer having high visible-light transmittance and dielectric strength.

INDUSTRIAL APPLICABILITY

As described above, the present invention provides an eco-friendly PDP with excellent display quality that includes a dielectric layer having minimized yellowing and deterioration of dielectric strength thereof. Thus, the PDP is useful for a large-screen display device and the like.

The invention claimed is:

1. A plasma display panel (PDP) comprising:

a front panel including display electrodes, a dielectric layer, and a protective layer that are formed on a glass substrate; and a rear panel including electrodes, barrier ribs, and phosphor layers that are formed on a substrate, wherein the front panel and the rear panel are faced with each other, and peripheries thereof are sealed to form a discharge space therebetween, wherein:

each of the display electrodes contains at least silver, the dielectric layer includes bismuth oxide, calcium oxide, barium oxide, and molybdenum trioxide, and the dielectric layer includes at least one of $Ag_2MoO_4$, $Ag_2Mo_2O_7$ and $Ag_2Mo_4O_{13}$.

2. The PDP of claim 1, wherein the dielectric layer includes 0.1 wt % to 7 wt % (inclusive) of molybdenum trioxide.

3. The PDP of claim 1, wherein the dielectric layer includes a first dielectric layer that covers the display electrodes and a second dielectric layer that covers the first dielectric layer, the first dielectric layer containing calcium oxide, and the second dielectric layer containing barium oxide.

4. The PDP of claim 3, wherein the first dielectric layer includes 20 wt % to 40 wt % (inclusive) of the bismuth oxide therein.

5. The PDP of claim 3, wherein the second dielectric layer includes 11 wt % to 40 wt % (inclusive) of the bismuth oxide therein.

6. The PDP of any one of claim 1 through claim 5, wherein the dielectric layer further includes at least one of zinc oxide, boron oxide, silicon dioxide, aluminum oxide, strontium oxide, and manganese dioxide.

7. The PDP of claim 3, wherein the first dielectric layer is thinner than the second dielectric layer.

8. The PDP of claim 7, wherein a thickness ratio of the second dielectric layer to the first dielectric layer is not less than 1.3 and not more than 7.2.

* * * * *